US007381930B2

(12) United States Patent
Fisher et al.

(10) Patent No.: US 7,381,930 B2
(45) Date of Patent: Jun. 3, 2008

(54) REMINDER FOR CONVECTION COOKING

(75) Inventors: Gary W. Fisher, Goodlettsville, TN (US); Sanjay R. Shukla, Hendersonville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 146 days.

(21) Appl. No.: 11/220,757

(22) Filed: Sep. 7, 2005

(65) Prior Publication Data

US 2006/0113295 A1 Jun. 1, 2006

Related U.S. Application Data

(60) Provisional application No. 60/608,990, filed on Sep. 10, 2004.

(51) Int. Cl.
*H05B 1/02* (2006.01)

(52) U.S. Cl. ..... 219/506; 219/400; 219/720; 219/492; 340/584; 340/384.1

(58) Field of Classification Search ..... 219/506, 219/483–486, 497, 412–414, 400, 720, 492; 99/325–331, 339; 340/584, 588, 815.4, 384.1
See application file for complete search history.

(56) References Cited

U.S. PATENT DOCUMENTS

| | | | | |
|---|---|---|---|---|
| 4,467,184 | A * | 8/1984 | Loessel | 219/506 |
| 4,625,086 | A * | 11/1986 | Karino | 219/720 |
| 5,736,717 | A * | 4/1998 | Lee et al. | 219/720 |
| 5,756,970 | A | 5/1998 | Barger et al. | |
| 6,777,651 | B1 | 8/2004 | Boyer | |

* cited by examiner

*Primary Examiner*—Mark Paschall
(74) *Attorney, Agent, or Firm*—Pearne & Gordon LLP

(57) ABSTRACT

Provided is a cooking appliance, such as a convection cooking appliance. The appliance includes a heating element, an annunciator, and a user interface for receiving a plurality of control settings from a user. The control settings include a time setting. The appliance further includes a controller operatively connected to the user interface for provision of the plurality of control settings to the controller. The controller includes an alarm point determination section for determining an alarm point based on the time setting, an annunciator control section for controlling the annunciator based on the alarm point, wherein the annunciator produces periodic annunciations, and a repeat period determination section for determining a repeat period for the periodic annunciations.

28 Claims, 3 Drawing Sheets

REMINDER FOR CONVECTION COOKING

CROSS-REFERENCE TO RELATED APPLICATIONS

Benefit of U.S. Provisional Patent Application Ser. No. 60/608,990, filed Sep. 10, 2004, is hereby claimed and the disclosure incorporated herein by reference.

BACKGROUND OF THE INVENTION

1. Field of the Invention

The present invention relates to cooking appliances, and more particularly to a reminder system for ovens, such as convection ovens.

2. Description of Related Art

Convection ovens use heated air that is forced into the oven by fans located in the back of the oven. By moving heated air past the food, convection ovens can perform cooking functions more quickly and at a lower temperature than standard conventional ovens. With a convection oven, there will be about a 25% to 30% decrease in cooking temperature and a 20% decrease in cooking time as compared to a conventional oven. Convection ovens are frequently used in industrial and commercial applications. However, convection ovens are often used for cooking food.

One advantage of convection ovens is that they provide efficient cooking of food. However, most recipes are written for conventional ovens. If a recipe designed for a conventional oven is strictly followed when using a convection oven, the food is likely to be overcooked. A user could adjust oven cook time and temperature by hand. However, such tasks could be burdensome and lead to miscalculations.

U.S. Pat. No. 5,756,970 discloses a convection oven capable of converting conventional oven cook times and temperatures to convection oven cook times and temperatures. Food type is one of the parameters used in the conversion algorithm. However, different recipes within a food type could each have different optimal cook times. For example, different cookie recipes could each have different optimal cook times within the food type "baked goods." The reference does not address variations in optimal cook times for different recipes within a food type. If the optimal cook time is less than the convection-converted cook time, overcooked food could result.

U.S. Pat. No. 6,777,651 discloses a convection oven that performs a rapid cook time calculation. This calculation is performed when a standard cook time, entered by a user, exceeds a predetermined amount. Also disclosed is signaling the user when the rapid cook time has elapsed without stopping the cooking process. The reference does not address repeated, periodic prompting of the user to check on the food.

Therefore, a need exists for a simple convection oven control system for repeatedly and periodically prompting or reminding a user to check on cooking food so that an optimal cooking time is not exceeded.

BRIEF SUMMARY OF THE INVENTION

In accordance with one aspect of the present invention, provided is a cooking appliance comprising a heating element, an annunciator, a user interface for receiving a plurality of control settings from a user, the control settings including a time setting, and a controller operatively connected to the user interface for provision of the plurality of control settings to the controller. The controller includes an alarm point determination section for determining an alarm point based on the time setting. The controller also includes an annunciator control section for controlling the annunciator based on the alarm point, wherein the annunciator produces periodic annunciations, and a repeat period determination section for determining a repeat period for the periodic annunciations.

In accordance with another aspect of the present invention, provided is a cooking appliance that provides for convection cooking comprising a heating element, a convection fan, an annunciator, a user interface for receiving a plurality of control settings from a user, the control settings including a temperature setting, a time setting, and a convection-convert request, and a controller operatively connected to the user interface for provision of the plurality of control settings to the controller. The controller includes a convection-converted temperature determination section for determining a convection-converted temperature, an alarm point determination section for determining an alarm point based on the time setting, a temperature control section for controlling at least one of the heating element and the convection fan based on the convection-converted temperature, and an annunciator control section for controlling the annunciator based on the alarm point, wherein the annunciator produces repeated annunciations.

In accordance with another aspect of the present invention, provided is a method of cooking food comprising the steps of providing a cooking appliance for radiant heat cooking and convection cooking, inputting a cooking temperature setting, initiating a convection cooking process, inputting a convection-convert request, determining a convection-converted temperature, determining an alarm point, and producing repeated annunciations based on the alarm point. The convection cooking process is one of a definite-time convection cooking process and an indefinite-time convection cooking process. The definite-time convection cooking process includes a time setting.

In accordance with another aspect of the present invention, provided is a convection cooking appliance comprising a bake element, a broil element, a convection fan, an annunciator, a temperature sensor for producing a temperature signal, and a user interface for receiving a plurality of control settings from a user, the control settings including a temperature setting, a time setting, and a convection-convert request. The convection-convert request occurs at a first remaining cooking time. The appliance further comprises a controller operatively connected to the user interface for provision of the plurality of control settings to the controller. The controller includes a convection-converted temperature calculation section for calculating a convection-converted temperature so that the convection-converted temperature is twenty-five degrees Fahrenheit less than the temperature setting. The controller also includes an alarm point calculation section for calculating an alarm point so that the alarm point is at about seventy-five percent of the first remaining cooking time. The alarm point occurs at a second remaining cooking time. The controller also includes a temperature control section for controlling at least one of the bake element, the broil element, and the convection fan based on the convection-converted temperature, and an annunciator control section for controlling the annunciator so that the annunciator produces periodically repeated audible annunciations after the alarm point during a convection cooking process. The periodically repeating audible annunciations have a repeat period of about one-fifth of the second remaining cooking time.

DETAILED DESCRIPTION OF THE INVENTION

Figure 1:
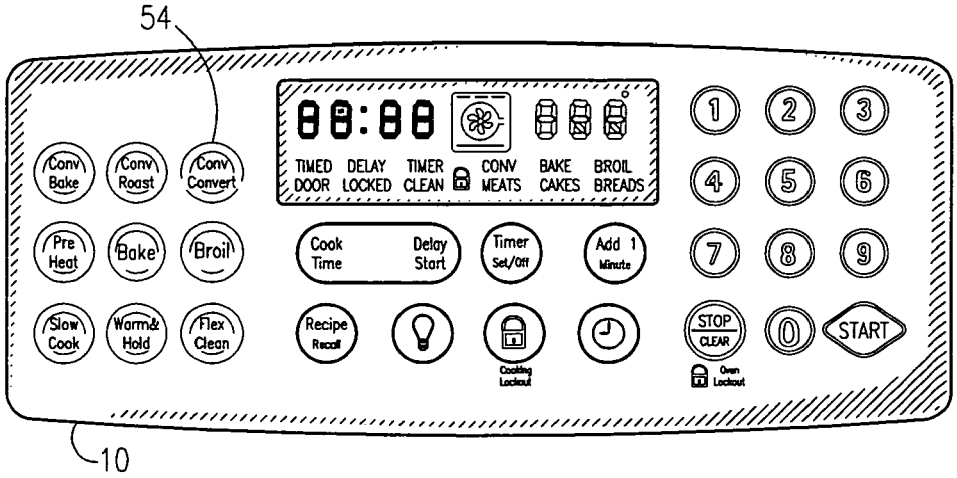
FIG. 1 is an example user interface for a cooking appliance that provides for convection cooking in accordance with one aspect of the present invention.

The present invention will now be described with reference to the drawings, wherein like reference numerals are used to refer to like elements throughout. It is to be appreciated that the various drawings are not drawn to scale from one figure to another nor inside a given figure, and in particular that the size of the components are arbitrarily drawn for facilitating the reading of the drawings. In the following description, for purposes of explanation, numerous specific details are set forth in order to provide a thorough understanding of the present invention. It may be evident, however, that the present invention may be practiced without these specific details.

FIG. 1 illustrates an example of a user interface 10 for a cooking appliance 12 (FIG. 2) that provides for convection cooking in accordance with an aspect of the present invention. The user interface 10 (FIG. 1) can include an electronic, touch-screen interface, or a touch sensitive, glass control interface, for example. However, any suitable interface can be employed and is contemplated as falling within the scope of the present invention. For example, the user interface 10 can include switches, such as membrane switches, rotary switches and/or pushbuttons. The user interface 10 can also include various display elements, such as pilot lights, light-emitting diodes (LEDs), liquid-crystal displays (LCDs), vacuum luminescent displays, plasma displays and/or cathode ray tubes (CRTs), for example.

Figure 2:
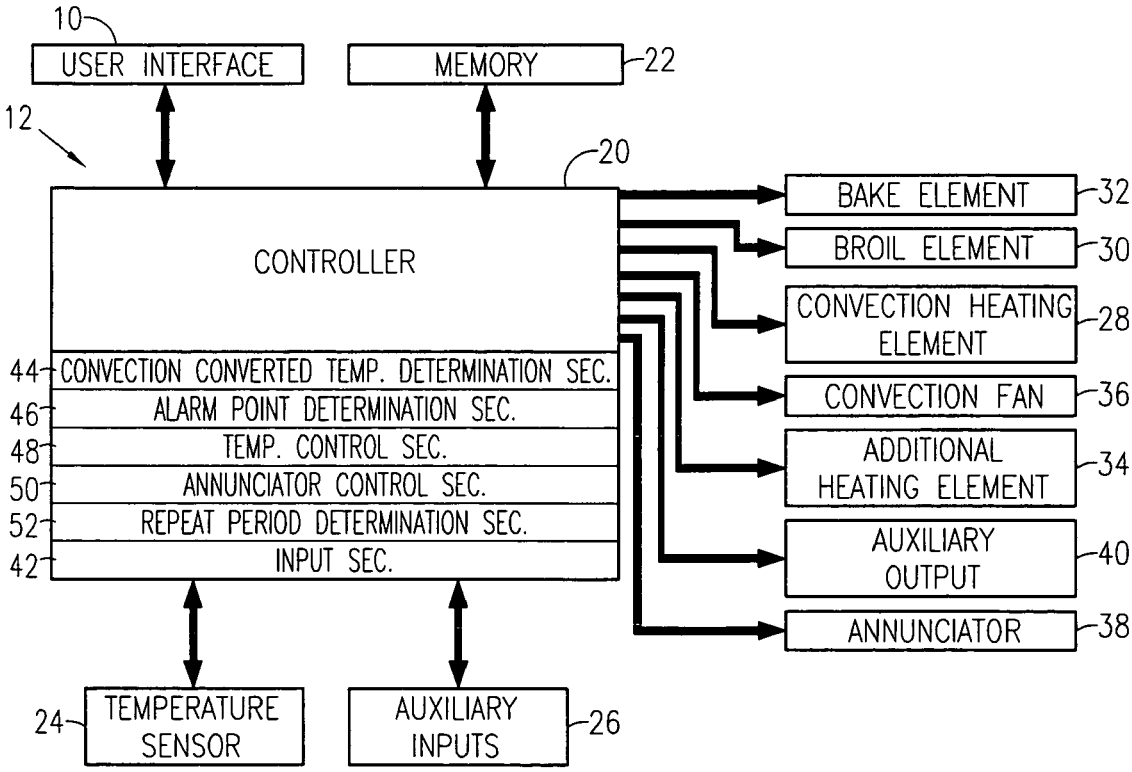
FIG. 2 is an example control system schematic for a cooking appliance that provides for convection cooking in accordance with one aspect of the present invention.

Turning to FIG. 2, it can be seen that, within the cooking appliance 12, the user interface 10 is operatively connected to the example controller 20 of an oven control system. A user can input various control settings for the cooking appliance 12 at the user interface 10. The user interface 10 receives the control settings and provides some or all of the settings to a controller 20.

The controller 20 can be an electronic controller, such as a microprocessor or microcontroller, for example. The controller 20 can also comprise a plurality of circuits. The controller 20 is further coupled to a memory 22, which includes known RAM modules for storing user inputs, EEPROM elements and/or or ROM memory known in the art for permanent storage of control system data. More specifically, the memory 22 can be loaded with cooking recipes, cooking algorithms, cooking parameters and data for operating oven heating elements, and a variety of oven option and selection menus, that facilitate user interaction and selection via the user interface 10. For a given cooking session, the controller 20 receives information, such as control settings, from the user interface 10 and/or the memory 22 and stores the information in memory or recalls information from memory for execution of a cooking routine by the controller. The controller 20 can monitor the state or status of various inputs, which may be analog or digital inputs. For example, the controller 20 can monitor the status of a temperature sensor 24 and additional auxiliary inputs 26. In an example embodiment, the temperature sensor 24 is configured to a produce a cooking temperature signal indicative of the current cooking temperature of the appliance. The controller can use this signal as a feedback control signal for controlling a cooking process. The signal may be digital or analog, and the controller 20 can include an analog to digital converter (A/D converter) for processing an analog signal.

The controller 20 is operatively connected to known oven heating elements including convection elements 28, thermal bake elements 32, and broil elements 30 for respective modes of cooking. Such elements are operationally responsive to the controller 20 for energization thereof through controlled switching devices such as relays, transistors, silicon controlled rectifiers (SCRs), triacs, or other known mechanisms (not shown) for cycling power to the oven heating elements. Power is supplied to the controller 20 from a power supply, and the controller cycles power from the same or another power supply to the oven heating elements to execute cooking algorithms.

In addition to controlling convection heating elements 28, broil heating elements 30, and bake heating elements 32, the controller 20 can control other devices through outputs, which may be analog or digital outputs. For example the controller 20 could control additional heating elements 34, a convection fan 36, an annunciator 38, or various auxiliary outputs 40. The annunciator 38 can include audible and/or visible annunciations indicative of, for example, an alarm condition or warning, such as a "check food" alarm, a time condition, such as the expiration of a timer, or an equipment malfunction condition. The annunciations can be audible, such as beeps, horns, chirps and the like. The annunciations can also be visible, such as a flashing light, illuminated warning light, or illuminated text or symbols.

In further embodiments, it is contemplated that the oven control system may be adapted for controlling additional oven heating elements beyond those depicted in FIG. 1 without departing from the scope and spirit of the present invention. For example, cooktop surface heating units, radiant cooking elements, microwave cooking elements, RF cooking elements, gas cooking elements, induction cooking elements, and light cooking elements may be controlled to implement a wide variety of oven features with a simple, user friendly interface.

The controller 20 includes various sections for carrying out control functions described below. For example, the controller 20 includes an input section 42 for inputting into the controller various signals, such as signals from the temperature sensor 24 and auxiliary inputs 26. The controller 20 includes a convection-converted temperature determination section 44 for determining a convection-converted temperature. The controller includes an alarm point determination section 46 for determining an alarm point. As will be described further below, periodic "check food" annunciations are provided by an example embodiment after the alarm point during a cooking process. The controller 20 includes a temperature control section 48 for controlling the appliance's various heating elements 28, 30, 32, 34 and the convection fan 36. The controller includes an annunciator control section 50 for controlling the operation of the annunciator 38. The controller 20 also includes a repeat period determination section 52. As will be described further below, in an example embodiment, the annunciator produces repeated periodic annunciations in which the controller 20 determines the repeat period.

Turning to the user interface 10, it includes a convection-convert request portion 54. The convection-convert request portion 54 can include a separate button, switch, or touch-sensitive area on the user interface 10. It is to be appreciated that the convection-convert request portion 54 can alternately be included as part of a single button or switch having multiple shared functions. When a convection-convert request has been made, the user interface 10 may indicate the request via one or more visual indicators, such as an LED, another annunciator, and/or an alphanumeric message.

The operation of an example embodiment will now be described. A cooking process, which may be a convection cooking process, is initiated, typically by a user. However, the cooking process may be initiated automatically, for example, by a delayed time cooking initialization. The cooking process is either a definite-time cooking process or an indefinite-time cooking process. The definite-time cooking process is a timed cooking process, such as for a fixed number of minutes or hours, for example. The indefinite-time cooking process is not timed and proceeds until the controller 20 receives or generates a stop command, such as a manual stop command from the user, for example.

If the cooking process is a definite-time cooking process, the controller 20 stores in memory 22 a time setting. The time setting can be received by the controller 20 as an input, for example, an input provided by the user through the user interface 10, or generated by the controller 20 through an algorithm or lookup table. The time setting establishes a cooking time interval, during which cooking occurs. The time setting may be input as an interval, such as two hours, for example, or a specific stopping point in time, such as 4:30 PM, for example. The controller 20 determines a stopping point for automatically stopping the definite-time cooking process based on the time setting.

In addition to the time setting, the controller 20 stores in memory 22 a temperature setting. The temperature setting can be received by the controller 20 as an input, for example, an input provided by the user through the user interface 10, or generated by the controller 20 through an algorithm or lookup table.

The time setting and temperature setting can be settings for a conventional radiant heat cooking process or a convection cooking process. However, a user may first initiate a conventional radiant heat cooking process and later decide to switch to a convection cooking process. In such a situation, it may be desirable to reduce the temperature setting and periodically check on the food's progress. The user can manually reduce the temperature setting and determine when and how frequently to check on the food. Alternatively, as will be described in detail below, the user may make a convection-convert request. In an example embodiment, the cooking appliance 12 automatically switches from conventional radiant heat cooking to convection cooking upon receiving a convection-convert request. When a convection-convert request is made, the controller 20 will initiate periodic check food alarms and typically reduce the cooking temperature below the temperature setting.

The controller 20 includes the convection-converted temperature determination section 44 for determining the convection-converted temperature. When a convection-convert request is made, the controller 20 will determine a convection-converted temperature for controlling one or more of the heating elements 28, 30, 32 and the convection fan 36 during the convection cooking process. The convection-converted temperature can be a lower temperature than the temperature setting or equal to the temperature setting. For example, the convection-converted temperature can be about 25° F. less than the temperature setting or some other predetermined temperature below the temperature setting. The convection-converted temperature can be based on a constant predetermined temperature, determined according to an algorithm, or found in a lookup table. If either of the temperature setting or convection-converted temperature fall below respective predetermined threshold temperature settings, the controller 20 can ignore the convection-convert request and control the cooking temperature of the convection cooking process based on the temperature setting and not based on the convection-converted temperature.

In an example embodiment, an audible and/or visible alarm annunciation is generated when a convection-convert request is rejected, and a minimum acceptable temperature setting is displayed on the user interface. The user can then accept the minimum acceptable temperature setting or input a higher temperature setting.

If the convection cooking process is a definite-time convection cooking process, the controller 20 will stop the process automatically at the stopping point, unless the cooking process is stopped earlier by the user or automatically due to an alarm condition or auxiliary input 26, for example. If the convection cooking process an indefinite-time convection cooking process, a manual stop by the user or a stop condition based on, for example, an auxiliary input 26 or an alarm condition, will stop the cooking process. Unlike the definite-time convection cooking process, the indefinite-time convection cooking process includes no time setting, and, therefore, no stopping point for automatically stopping the cooking process.

If the convection cooking process is a definite-time convection cooking process and a convection-convert request has been made, the controller 20 will control the annunciator 38 to produce repeated "check food" annunciations after a determined point in time during the cooking process called the alarm point. In an example embodiment, the controller 20 includes the alarm point determination section 46 for determining the alarm point. The controller 20 also includes the repeat period determination section 52 for determining when the annunciations are repeated or determining a repeat period for the annunciations.

The alarm point determination section 46 determines the alarm point based on the time setting stored in memory 22. The time setting establishes the cooking time interval. In an example embodiment, the controller 20 sets the alarm point at a percentage or fraction of the cooking time interval. For example, the alarm point can be set at about 80% of the cooking time interval, or at some point less than about 80% of the cooking time interval, such as at about 75% of the cooking time interval, or at about 60% of the cooking time interval.

In a further example embodiment, the controller 20 sets the alarm point at a percentage of a first remaining cooking time, such as the remaining cooking time at the moment when the convection-convert request is made by a user. For example, if a user makes the convection-convert request one hour into a cooking process having a two-hour time setting, the controller 20 can set the alarm point at a percentage of the remaining one hour of cooking time. The alarm point can be set at any percentage of the first remaining cooking time, such as at about 80% of the first remaining cooking time, or at about 75% of the first remaining cooking time, or at about 60% of the first remaining cooking time. The alarm point can be calculated by the controller 20 or obtained from a lookup table.

The alarm point is a point in time during the convection cooking process for starting the repeated annunciations. The alarm point can be determined based on a percentage of either of the cooking time interval or the first remaining cooking time, as described above. Alternatively, the alarm point could be determined according to other algorithms, such as a fixed time prior to the stopping point, for example. After the convection cooking process reaches the alarm point, repeated annunciations begin.

Repeated "check food" annunciations begin at or after the convection cooking process reaches the alarm point. The repeated annunciations may be intermittent or periodic. Periodic annunciations repeat periodically and have a repeat period between annunciations. The controller 20 includes the repeat period determination section 52 for determining the repeat period. The repeat period determination can be done through an algorithm or lookup table, or be a fixed, predetermined period. In an example embodiment, the alarm point is reached at a second remaining cooking time. The repeat period can be a fraction or percentage of the second remaining cooking time. For example, the repeat period can be about one-fifth of the second remaining cooking time, or some smaller or larger fraction of the second remaining cooking time, such as about one-fourth, about one-third, or about one-half. The fraction used will determine the number of repeated, periodic "check food" annunciations that occur from the alarm point to the stopping point.

In an example embodiment, repeated, periodic annunciations are not produced when the repeat period is less than a predetermined period. It will be appreciated than the predetermined period can be any length of time. For example, the production of repeated, periodic annunciations can be skipped when the repeat period is one minute or less. Although the production of repeated, periodic annunciations can be skipped when the repeat period is less than a predetermined period, annunciations could still be produced at the alarm point and/or the stopping point. In a still further embodiment, repeated, periodic annunciations are not produced when the second remaining cooking time is less than a predetermined length of time, such as five minutes, for example. It will be appreciated that the predetermined length of time can be any length of time.

Figure 3:
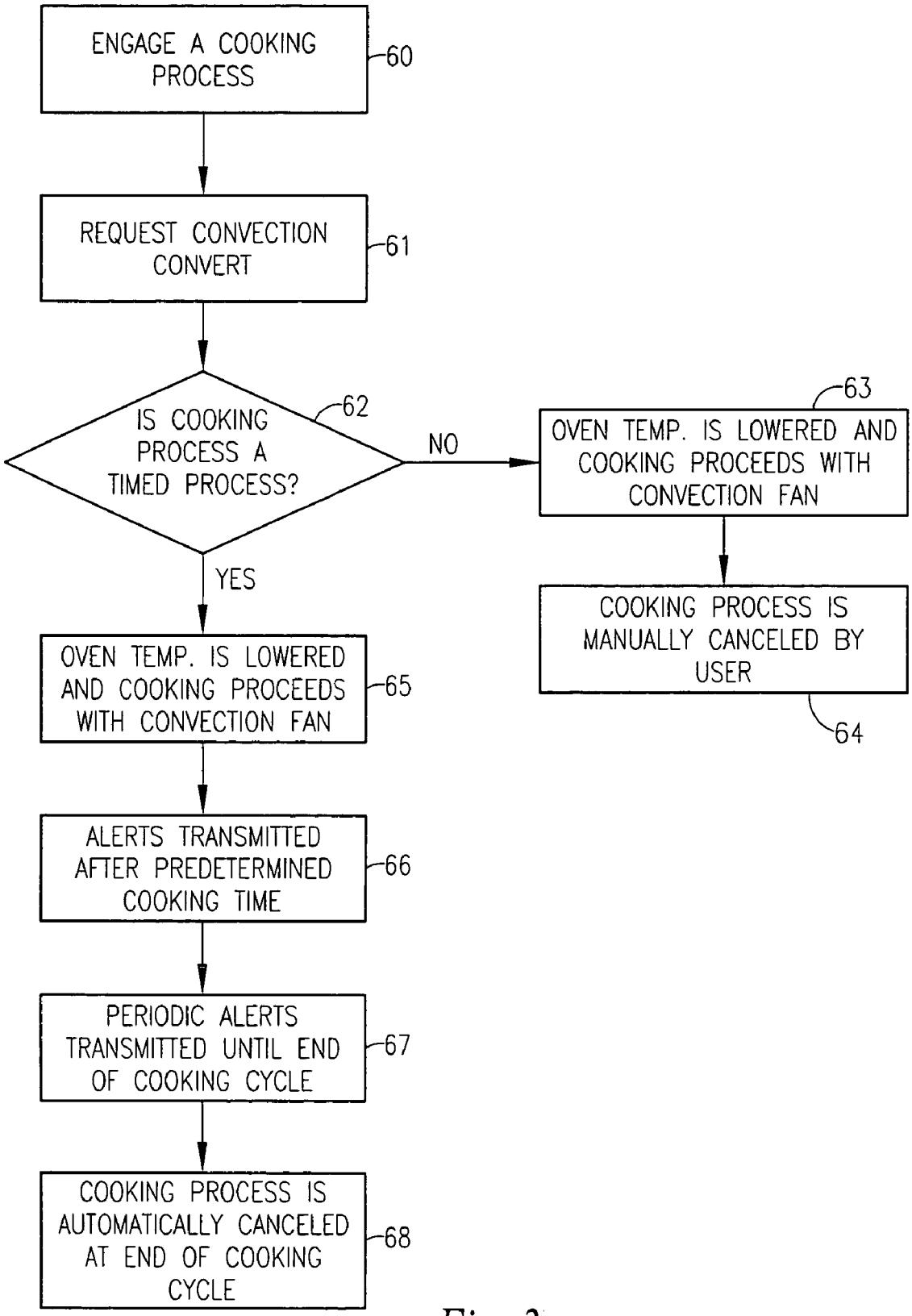
FIG. 3 is a flowchart of an overview example methodology of convection cooking in accordance with one aspect of the present invention.

FIG. 3 illustrates an overview example methodology for convection cooking. The methodology begins by engaging a timed or non-timed cooking process, such as a bake, timed bake, or a delayed timed bake function (60). It is to be appreciated that any suitable cooking function can be engaged, such as a broil or roast, etc. A convection-convert request is then made (61). If the convection-convert request is made after a non-timed cooking function (62) has been engaged, the control lowers a temperature of the oven by a predetermined temperature, for example, 25° F. (63). The predetermined temperature can be a constant temperature, computed from an algorithm, or can be determined by a lookup table. After the convection-convert request is accepted, cooking proceeds with the use of the convection fan. Different combinations of bake, broil, convection or convection assist heating elements can be used during cooking. The non-timed convection cooking process will continue until manually canceled by a user (64).

On the other hand, if a convection-convert request is made after a timed cooking process (62) is engaged, such as a timed bake or delayed timed bake, has been engaged, the control lowers the oven temperature by a predetermined temperature, for example, 25° F. (65). The predetermined temperature can be a constant temperature, computed from an algorithm, or can be determined by a lookup table. After the convection-convert request is accepted, cooking proceeds with the use of the convection fan. Different combinations of bake, broil, convection or convection assist heating elements can be used during cooking. It is noted that if the cooking temperature is below a preset limit, the convection-convert request may be denied, or considered non-executable.

Additionally, after a predetermined amount of cooking time has elapsed, for example about 75% of the cooking time interval, the control initiates annunciations indicating that the user should check the food in the oven (66). For instance, the control could display a "CF" for "Check Food". Additionally, or alternatively, an audio tone can also be sounded to alert the user to check the food. It is to be appreciated that any suitable visual or audible message(s) can be conveyed to the user, such as an LED, an alphanumeric message, a visual annunciator, etc. This message is an initial reminder for a user to check the food. The computation of the initial reminder has no minimum threshold time; the computation takes place on any acceptable programmed cooking time.

The control can then send periodic visual and/or audio reminders for the user to check the food in the oven (67). For instance, the periodic reminders can be spaced at about one-fifth of the remaining time of the programmed cooking time. However, it is to be appreciated that the periodic reminders can be spaced in any suitable manner. The spacing of the reminders can be based on a lookup table or computed with an algorithm based on the programmed cooking time. Moreover, the user can customize how and/or when he/she would like to receive the reminders.

The cooking function can then be automatically cancelled at an end of the cooking time interval (68), that is, at the stopping point. Alternatively, at the stopping point, the control can send a continuous alert until the alert is manually deactivated.

Figure 4:
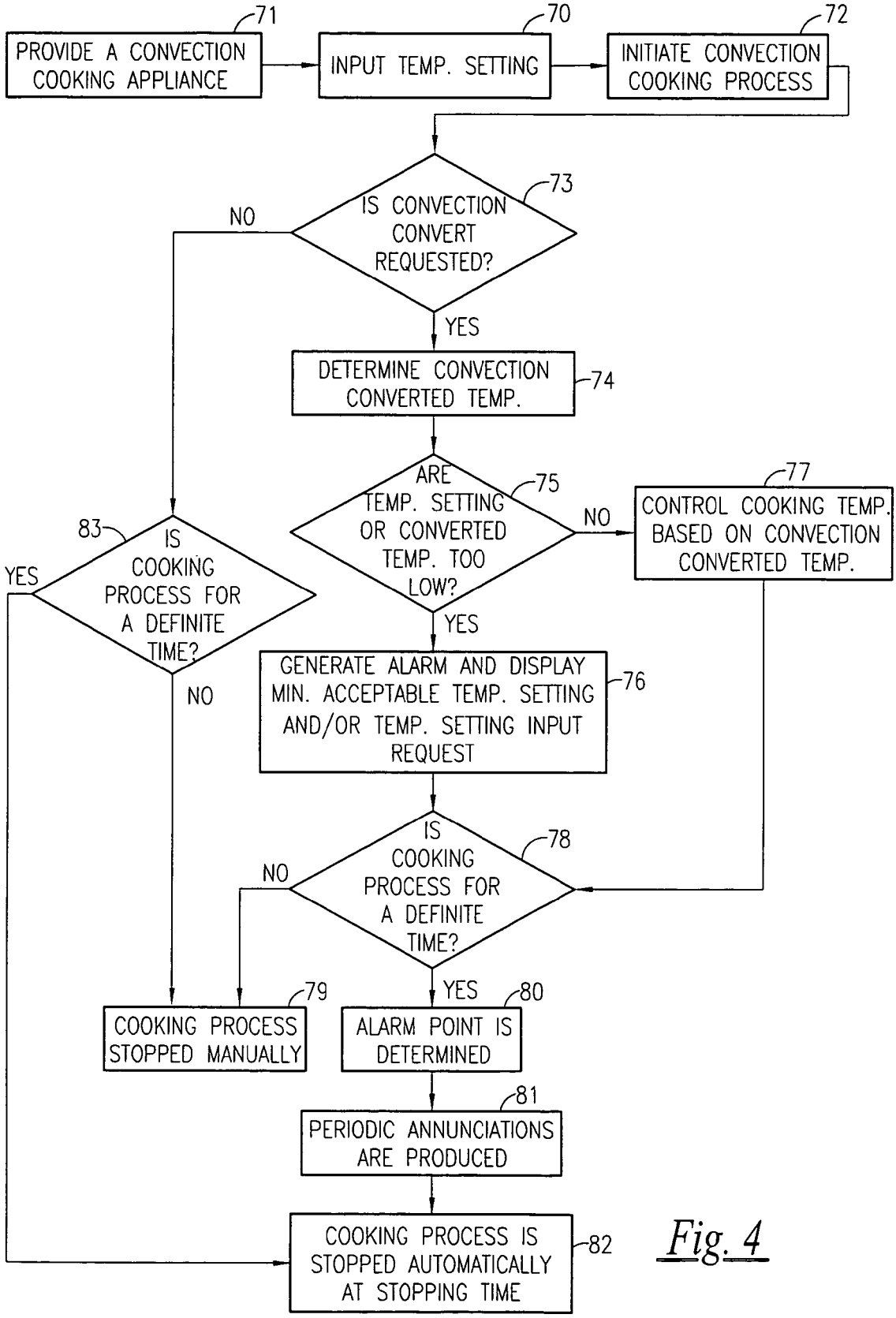
FIG. 4 is a flowchart of a detailed example methodology of convection cooking in accordance with one aspect of the present invention.

Turning to FIG. 4, a more detailed example methodology for convection cooking is illustrated. A user inputs a temperature setting (70) for a cooking appliance for providing convection cooking (71) and initiates a convection cooking process (72).

If a convection-convert request is not made (73) by the user, and the convection cooking process is for an indefinite time (83), the process is stopped manually by the user (79), or according to some other condition, such as an alarm condition, for example. However, if the convection cooking process is for a definite time (83), the cooking process is automatically stopped at the stopping point (82), unless stopped earlier by the user or automatically due to an alarm condition, for example.

If a convection-convert request is made (73) by the user, the appliance will determine a convection-converted temperature (74). If either of the temperature setting or the convection-converted temperature are below respective predetermined temperatures, that is, if either are too low (75), an audible and/or visible alarm annunciation is generated and a minimum acceptable temperature setting and/or a prompt to input a temperature setting are displayed (76). In an example embodiment, if a convection-convert request is made (73) by the user and either of the temperature setting or the convection-converted temperature are too low, the convection cooking process proceeds based on the temperature setting. However, if the temperature setting and convection-converted temperature are acceptable, the convection cooking process proceeds based on the convection-converted temperature (77).

If the convection cooking process is for an indefinite time (78), the process is stopped manually by the user (79), or according to some other condition, such as an alarm condition, for example. However, if the convection cooking process is for a definite time (78), an alarm point is determined (80) and periodic annunciations are produced (81) after the alarm point is reached. Unless stopped earlier by a user or automatically due to an alarm condition, for example, the cooking process is automatically stopped at the stopping point (82).

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A cooking appliance comprising:
- a heating element;
- an annunciator;
- a user interface for receiving a plurality of control settings from a user, the control settings including a time setting; and
- a controller operatively connected to the user interface for provision of the plurality of control settings to the controller, wherein the controller includes:
  - an alarm point determination section for determining an alarm point based on the time setting;
  - an annunciator control section for controlling the annunciator based on the alarm point, wherein the annunciator produces periodic annunciations; and
  - a repeat period determination section for determining a repeat period for the periodic annunciations,
  - wherein the alarm point is at a remaining cooking time, and further wherein the repeat period is a fraction of the remaining cooking time.

2. The appliance of claim 1, wherein the fraction is about one-fifth.

3. A cooking appliance that provides for convection cooking comprising:
- a heating element;
- a convection fan;
- an annunciator;
- a user interface for receiving a plurality of control settings from a user, the control settings including a temperature setting, a time setting, and a convection-convert request; and
- a controller operatively connected to the user interface for provision of the plurality of control settings to the controller, wherein the controller includes:
  - a convection-converted temperature determination section for determining a convection-converted temperature;
  - an alarm point determination section for determining an alarm point based on the time setting;
  - a temperature control section for controlling at least one of the heating element and the convection fan based on the convection-converted temperature; and
  - an annunciator control section for controlling the annunciator based on the alarm point, wherein the annunciator produces repeated annunciations,
  - wherein the alarm point occurs at a remaining cooking time.

4. The appliance of claim 3, wherein the repeated annunciations include audible annunciations.

5. The appliance of claim 3, wherein the repeated annunciations include visible annunciations.

6. The appliance of claim 3, wherein the repeated annunciations include audible and visible annunciations.

7. The appliance of claim 3, wherein the time setting at least partially defines a cooking time interval, and further wherein the alarm point is at about seventy-five percent of the cooking time interval.

8. The appliance of claim 3, wherein the convection-convert request occurs at a remaining cooking time, and further wherein the alarm point is at about seventy-five percent of the remaining cooking time.

9. The appliance of claim 3, wherein the repeated annunciations repeat intermittently.

10. The appliance of claim 3, wherein the repeated annunciations repeat periodically.

11. The appliance of claim 10, wherein the controller further includes a repeat period determination section for determining a repeat period for the repeated annunciations.

12. The appliance of claim 11, wherein the repeated annunciations consist of two annunciations when the repeat period is less than a predetermined period.

13. The appliance of claim 12, wherein the predetermined period is one minute.

14. The appliance of claim 11, wherein the repeat period is a fraction of the remaining cooking time.

15. The appliance of claim 14, wherein the fraction is about one-fifth.

16. The appliance of claim 14, wherein the fraction is not greater than one-fourth.

17. The appliance of claim 14, wherein the fraction is not greater than one-third.

18. A method of cooking food comprising the steps of:
- providing a cooking appliance for radiant heat cooking and convection cooking;
- inputting a cooking temperature setting;
- initiating a convection cooking process, wherein the convection cooking process is one of a definite-time convection cooking process and an indefinite-time convection cooking process, and further wherein the definite-time convection cooking process includes a time setting;
- inputting a convection-convert request;
- determining a convection-converted temperature;
- determining an alarm point, the alarm point occuring at a remaining cooking time; and
- producing repeated annunciations based on the alarm point.

19. The method of claim 18, further comprising the step of controlling a cooking process based on the temperature setting and not based on the convection-converted temperature when any one of the temperature setting and the convection-converted temperature are less than a predetermined temperature.

20. The method of claim 18, further comprising the step of stopping the convection cooking process, wherein the stopping step occurs automatically when the convection cooking process is a definite-time convection cooking process, and further wherein the stopping step occurs manually when the convection cooking process is an indefinite-time convection cooking process.

21. The method of claim 18, wherein the time setting at least partially defines a cooking time interval, and further wherein the alarm point is at about seventy-five percent of the cooking time interval.

22. The method of claim 18, wherein the step of inputting a convection-convert request occurs at a first remaining cooking time, and further wherein the alarm point is at about seventy-five percent of the first remaining cooking time.

23. The method of claim 18, wherein the repeated annunciations are periodic annunciations having a repeat period.

24. The method of claim 23, wherein the alarm point occurs at a second remaining cooking time, and further wherein the repeat period is a fraction of the second remaining cooking time.

25. The method of claim 24, wherein the fraction not greater than one-third.

26. The method of claim 24, wherein the fraction is about one-fifth.

27. The method of claim 24, wherein the repeated annunciations consist of two annunciations when the repeat period is less than a predetermined period.

28. A convection cooking appliance comprising:

a bake element;

a broil element;

a convection fan;

an annunciator;

a temperature sensor for producing a temperature signal;

a user interface for receiving a plurality of control settings from a user, the control settings including a temperature setting, a time setting, and a convection-convert request, wherein the convection-convert request occurs at a first remaining cooking time; and a controller operatively connected to the user interface for provision of the plurality of control settings to the controller, wherein the controller includes:

a convection-converted temperature calculation section for calculating a convection-converted temperature so that the convection-converted temperature is twenty-five degrees Fahrenheit less than the temperature setting;

an alarm point calculation section for calculating an alarm point so that the alarm point is at about seventy-five percent of the first remaining cooking time, wherein the alarm point occurs at a second remaining cooking time;

a temperature control section for controlling at least one of the bake element, the broil element, and the convection fan based on the convection-converted temperature; and an annunciator control section for controlling the annunciator so that the annunciator produces periodically repeated audible annunciations after the alarm point during a convection cooking process, wherein the periodically repeating audible annunciations have a repeat period of about one-fifth of the second remaining cooking time.

* * * * *